US007104864B1

(12) United States Patent
Liou

(10) Patent No.: US 7,104,864 B1
(45) Date of Patent: Sep. 12, 2006

(54) BLOCKS AND BUILDING SYSTEM FOR THE CONSTRUCTION OF LIFESIZE INFLATABLE PLAY STRUCTURES

(76) Inventor: Dick Liou, 47 North St., Lexington, MA (US) 02420

( * ) Notice: Subject to any disclaimer, the term of this patent is extended or adjusted under 35 U.S.C. 154(b) by 178 days.

(21) Appl. No.: 10/710,501

(22) Filed: Jul. 15, 2004

Related U.S. Application Data

(60) Provisional application No. 60/521,004, filed on Feb. 4, 2004.

(51) Int. Cl.
*A63H 3/06* (2006.01)

(52) U.S. Cl. ..... 446/221; 446/223; 446/230; 446/479; 472/134

(58) Field of Classification Search ..... 446/220, 446/85, 478, 476, 487; 5/655.3, 723; 24/306, 24/442; 52/2.11; 441/129–132, 38, 40
See application file for complete search history.

(56) References Cited

U.S. PATENT DOCUMENTS

| | | | | |
|---|---|---|---|---|
| 3,994,102 | A | 11/1976 | Johnson | 52/2 |
| 4,026,087 | A | 5/1977 | White | 52/608 |
| 4,459,714 | A * | 7/1984 | Lin | 5/655.3 |
| 4,629,182 | A | 12/1986 | Rader | 482/35 |
| 4,698,023 | A | 10/1987 | Marino | 434/259 |
| 4,708,684 | A | 11/1987 | Chen | 446/127 |
| 4,884,988 | A | 12/1989 | McMurray | 446/115 |
| 4,978,301 | A * | 12/1990 | Dodge | 434/96 |
| 5,145,440 | A | 9/1992 | Boris | 446/106 |
| 5,273,477 | A | 12/1993 | Adams | 446/108 |
| 5,330,379 | A * | 7/1994 | Roh et al. | 446/71 |
| 5,458,522 | A | 10/1995 | Brooks | 446/85 |
| 5,620,396 | A | 4/1997 | Westphal | 482/35 |
| 5,678,357 | A | 10/1997 | Rubio | 52/2 |
| 5,846,114 | A | 12/1998 | Frandsen | 446/106 |
| 5,906,530 | A | 5/1999 | Lindsey | 446/85 |
| 5,938,497 | A * | 8/1999 | Mott | 446/122 |
| 5,947,786 | A | 9/1999 | Glick | 446/85 |
| 6,131,249 | A * | 10/2000 | Suenaga | 24/306 |
| 6,173,538 | B1 | 1/2001 | Fleishman | 52/81 |
| 6,554,677 | B1 | 4/2003 | Leemon | 446/122 |
| 6,565,405 | B1 | 5/2003 | Hsu | 446/89 |

FOREIGN PATENT DOCUMENTS

| | | | |
|---|---|---|---|
| DE | 3704105 | A1 * | 11/1988 |
| DE | 20111051 | U1 * | 12/2001 |
| GB | 2359262 | A * | 8/2001 |
| JP | 2001245767 | A * | 9/2001 |
| WO | WO 3084369 | A1 * | 10/2003 |

* cited by examiner

*Primary Examiner*—Kien Nguyen
(74) *Attorney, Agent, or Firm*—Mark P. White

(57) ABSTRACT

A system for the construction of life size play structures includes a multiplicity of inflatable building blocks, each being a member of a finite set of different multi-sided block types. Each such type is a cylinder having the cross section of a regular polyhedron, and the length of each side of each polyhedron is identical. The blocks are attached to each other by means of a rotating joint which aligns each contiguous side of each block with the contiguous side of the adjoining block, but which does not allow each such to translate relative to the adjoining block. The joints are constructed at fixed locations along the sides according to specific dimensional ratios. Stiffening means are used to maintain the dimensional integrity of each block, and to maintain the uniformity of the system from block to block.

10 Claims, 11 Drawing Sheets

FIG.2A Top View

Side View

Bottom View

Rhombus

Trapezoid

Prism

Pyramid

Stacking (0°, 360°)

Acute Angles (60°)

Orthogonal (90°)

Coplanar (180°)

BLOCKS AND BUILDING SYSTEM FOR THE CONSTRUCTION OF LIFESIZE INFLATABLE PLAY STRUCTURES

This patent claims priority based on Provisional Patent No. 60/521,004, filed on Feb. 4, 2004.

BACKGROUND OF INVENTION

Construction toys are designed and manufactured primarily to encourage and allow for free play and/or simulated real-life interactions. While the majority of construction toys tend to be of a miniature size, there is a separate category of toys that leverage the same concepts onto larger, near life-size structures. To this end, it has been reported that children from the age of 3 and above consistently display the tendency to play with large, near life-size structures whether built with manufactured configurations or homemade structures from blankets, pillows, and any furniture that can be arranged for support.

Within the category of large play structures, two distinct classes emerge. One class is pre-constructed, often fixed sizes and shapes for the sole purpose of providing for playing in and around such structures. The second class generally allows the assembly of a large play structure by children using different materials and methods. It is in this second category that the present invention resides.

In this second class, various types of construction methods and materials have been utilized to enable the children to create either particular play structures or less frequently, free forms and different configurations. In either case, such methods range from using similar, mass producible components that either interconnect via locking geometric shapes or fasten via external means and materials. These fastening material also vary widely.

Despite the attempts to provide for simulated life-interactions or just simple child's play, the products that exist within this category possess multiple shortcomings. The most obvious problem is the size of the fully assembled (fixed design) structure. Products that provide for life-size play whereby children can be allowed to enter, exit, or thereby occupy the said structure are typically of sufficient sizes that require large indoor spaces. A direct translation of this problem is the storage space required of such play structures once the play session is over. U.S. Pat. No. 4,978,301 (Dodge) provides construction pieces and connection strips for a final structure. Both the finished structure and the subsequent storage of the dismantled components illustrate this problem.

Another problem with existing play structure products is the lack of versatility. A few of the products attempt to address this issue by offering the ability to connect several separate structures. These designs, while providing for some variability of play, ultimately serve a single or limited play settings. Most products in this category have (if any) openings with covers in fixed positions simulating doors or windows, thus limiting the versatility of free play. With the fixed designs, a child's ability to explore, be creative, and learn from playing becomes limited. Despite claims of unlimited variability in final design, realistically U.S. Pat. No. 6,565,405 (Hsu, et al) provides only for very limited configurations based on three separate fixed-design objects.

A related problem to the existing structures defined as life-size is the actual size of the assembled configuration. While sufficiently large to allow small children to physically enter, exit, and occupy the said space, these structures are often too small for adults or older children who may participate in the social play. Hence, the definition of life-size is more accurately narrowed down to children's life-size, and not the real life-size as in everyday living. U.S. Pat. No. 4,629,182 (Rader) is an example of such structures. Because of this size limitation, adults, if engaged by the children, typically observe but do not actively participate in the play session. This deficiency restricts the extent to which social interactions can be achieved when adults are fully engaged in physical play with the children.

Yet another problem with the existing products is manifested with the types of material used in the manufacturing of these structures. Historically products have been designed and constructed with rigid materials such as wood, aluminum, heavy plastic, and other common building materials. Many of these materials present inherent risks when used as the composition of the play structure; they often pose too much structural rigidity which could cause physical harm if too much force is exerted upon them by the child. The toy tunnel structure described in U.S. Pat. No. 5,620,396 (Westphal) is an example of this type of rigid construction with hard surfaces.

Given the safety requirements of a child's play environment, many products have gone the route of using lightweight material such as foam, cardboard, vinyl, cloth, or a combination thereof. While the lighter materials are easier to handle, many cannot withstand the actual and reasonable force exerted by children in normal and sometimes rough play. This is especially true for designs made of vinyl that utilize an interlocking system. As demonstrated with actual prototypes built with vinyl inflatable material, and similarly depicted in the illustrations of U.S. Pat. No. 5,273,477 (Adams), over-inflation of said vinyl causes rigidity and difficulty in assembly while under-inflation causes interlocking structures to wobble; all the while the concept of maintaining a constant and consistent air pressure within an inflatable vinyl structure is not practically realistic. On the other hand, other designs that utilize an interconnecting method may contain either insufficient connectors to provide for structural integrity, or too many connectors that become cumbersome for quick connectivity and release. The amount of time it would require a child to assemble a structure as depicted in U.S. Pat. No. 4,708,684 (Chen) and U.S. Pat. No. 6,554,677 (Leemon) clearly illustrates this point. Likewise, inappropriately designed connectors could present safety hazards similar to those used in the rigid material constructions.

In these respects, the blocks-and-building system according to the present invention substantially departs from the conventional concepts and designs of the prior arts, and in so doing provides a superior methodology primarily developed for the enjoyment and utilization of boundless play structure configurations.

In view of the shortcomings inherent in the presently available play structures as described in the prior arts, the present invention provides a superior design whereby a design and system are made available to allow for novel methodologies for the construction and enjoyment of boundless play structures based on simple baseline units coupled with specifically engineered connector designs. Both the design of the baseline units and the system by which multiple configurations can be made will be described subsequently in greater detail. It should be noted that the resulting novel design of the present invention and its numerous benefits are not anticipated, rendered obvious, suggested, demonstrated, or even implied by any of the prior art play structures.

To accomplish this, the present invention requires geometric, inflatable blocks sufficiently light to be handled by small children while allowing unlimited scalability and versatility in designs and final structures. Specifically, the key to the potential of this present invention lies in the composition of the light, inflatable/deflatable material, and structural strength of the building units. Most importantly, it lies with the optimized specific design surrounding the connectors that meets each and every one of the objectives stated below. The baseline building block units have been designed to utilize heat sealed connectors capable of providing unanticipated motions and degrees of freedom rendering boundless configurations and unending creativity.

SUMMARY OF INVENTION

The following objectives outline the broad features of the present invention in order that the detailed descriptions may be better comprehended. There are more detailed descriptions hereinafter. In this respect, it should be understood that the descriptions and illustrations by no means bound the usefulness or applications fully extendable with the present invention. The invention is capable of other embodiments and can be utilized in numerous ways limited only by imagination.

A primary object of the present invention is to provide for a design and system by which shortcomings of the prior art can be overcome.

An object of the present invention is to provide for a means to construct play structures by utilizing inflatable baseline building blocks in common geometric shapes to be manufactured with vinyl.

Another object of the present invention is to allow for the building and enjoyment of said play structure in common and virtually any sized rooms without adversely causing undue difficulties, congestion, or dangerous environments due to overcrowding.

Another object of the present invention is to allow for the ease of storage of the said structures by means of deflation and the resulting reduction in storage space requirement.

Another object of the present invention is to allow for and encourage the versatility of completed structures bound only by imagination.

Another object of the present invention is to provide for privacy, which has been studied and identified as one of the main driving forces behind children's relentless building of various forts and hideouts. At the same time, the transparent/translucent properties of the blocks ensure that guardians can observe the children's activities.

Another object of the present invention is to allow for imagined play as well as for simulated real-life transactional play using near or life size structures such as food stands, furniture, etc.

Another object of the present invention is to provide for final configurations of sufficient sizes such that not only children, but adults can participate in the play session. By virtue of this capability it is hoped that social interactions within the family and amongst peers not limited to specific age groups can be promoted.

Another object of the present invention is to provide for a relatively safe play environment using proven material (PVC) to ensure non-rigid, soft, and nonabrasive material supplemented with a cushion of air.

Another object of the present invention is to create a design whereby structural integrity and product durability are maintained within reasonable forces exerted by normal and occasionally rough play.

Another object of the present invention is to overcome the difficulty of assembly and the structural integrity issues associated with either over-inflation and under-inflation of PVC type play structures constructed of the interlocking design respectively. By the same token, it is an object of this invention to overcome problems associated with too few or too many connectors that either hinder structural integrity or cause undue difficulties and time consumption in the assembly process.

Another object of the present invention is to provide for an unprecedented ease of motion, or degree of freedom, for the piece parts of the structural units as intended by user's design, thereby simulating real life movements of physical structures such as doors, windows, panels, and other types of enclosures with openings.

Another object is to provide for an educational setting whereby children learn of the geometric shapes' dimensions and their interactions, assembly, and construction of other more complex geometric shapes by virtue of combination of the baseline units. In this spirit children can gain an advanced appreciation for the 3-dimensional properties of said geometric shapes and learn to maneuver the shapes in physical form which inadvertently contributes to the children's ability to visualize objects and their geometric components in the spatial and cognitive levels.

Another object is to create a product that is visually appealing not only in its building block form, but especially in its final structure based on color and shape combinations.

Another object is to design the product which optimizes the desired benefits while meeting the requirement of low manufacturing cost and affordability for mass market consumption.

Other objects and advantages of the present invention will become apparent to the reader with the aid of the accompanying drawings. Configurations drawn by no means bound the versatility of configurations and benefits thereof in the present invention. The drawings are for illustrative purpose only, and changes in basic geometric designs are not limited to those shown. In the same way, connective materials are not limited by the illustrations and changes may be made in specific configurations.

In accordance with a first aspect of the invention a system for the construction of life size play structures comprises a multiplicity of inflatable blocks, wherein each block further includes an identical top polygonal surface 11 and bottom polygonal surface 12, each surface comprising a multiplicity of surface seams 42 at the periphery of the surface and each surface seam comprising two ends sL1, sL2.

In accordance with a second aspect of the invention each block further includes a multiplicity of side panels 45, each joining a top surface seam with the corresponding bottom surface seam, each side panel affixed to an adjacent side panel by means of a side panel seam 50 having two ends sL2, sL3.

In accordance with a third aspect of the invention each block includes a multiplicity of strap connectors and a multiplicity of flap connectors, whereby two or more connectors are affixed in proximity to each seam of the top surface, and whereby two or more connectors are affixed in proximity to each seam of the bottom surface, whereby strap connectors and flap connectors are alternated about the seams on each surface.

In accordance with a fourth aspect of the invention each strap connector comprises a strap which affixes to a slit in a corresponding flap connector on another block.

In accordance with a fifth aspect of the invention each end connector has a center line which is located at a distance DC from the nearest seam end, where DC is defined by $$DC=L/(2n)$$

where l is the length of the seam, and n is the number of connectors on the seam, and wherein each connector on each surface seam has a center line located at a distance of 2*DC from the nearest other connector on the same surface seam.

In accordance with a sixth aspect of the invention each flap connector on the upper surface is adjacent to a flap connector on the lower surface, and whereby each strap connector on the upper surface is adjacent to a strap connector on the lower surface.

In accordance with a seventh aspect of the invention each strap connector comprises a cruciate mount comprising a horizontal area, an upper vertical area and a lower vertical area, wherein a portion of male hook-and-loop material is affixed to the upper vertical area, and a portion of female hook-and-loop material is affixed to the lower vertical area, and whereby the horizontal area is affixed to an oval mount.

In accordance with an eighth aspect of the invention each flap connector has formed within it two or more slits, each approximately 125% of the width of the vertical area of a corresponding strap connector, and wherein each flap connector further comprises a mounting area in proximity to a bottom edge of the flap connector, and which is affixed to a corresponding oval mount.

In accordance with a ninth aspect of the invention each slit of each flap connector has needle eyes terminating each end.

In accordance with a tenth aspect of the invention for each flap connector the slits are disposed parallel to each other, and wherein the distance between each slit and an adjacent slit is equal to the distance between an uppermost slit and an upper edge of the flap connector, and is further equal to the distance between each needle eye and the closest point on an edge of the flap connector.

In accordance with an eleventh aspect of the invention for each flap the distance of the first slit from any edge of the vinyl flap will be equal to the separation between the first and the second slits of the flap.

In accordance with a twelfth aspect of the invention the distance between the second slit and the base of the flap are such that: (a) when placing a first block and a second block side by side, with the side panels touching, so that each strap will face a corresponding flap; and (b) with the side panels of each block touching, but not squeezed together with any force, and a fully extended, each flap is ½ inch away from the baseline of the corresponding strap, then the following equations will hold for a particular strap and flap:

$$(c)\ D=A+B1+B2+C$$

$$(d)\ F=D-E$$

where: (e) A is the distance between the flap base and a corresponding seam; (f) B1 is the bulge of the first block; (g) B2 is the bulge of the second block; (h) C is the distance between the strap base and the corresponding seam line; (i) D is the total distance between the base of the flap and the base of the strap; (j) E is the distance between a tip of the flap and the strap base; and (k) F is the flap length

BRIEF DESCRIPTION OF DRAWINGS

These, and further features of the invention, may be better understood with reference to the accompanying specification and drawings depicting the preferred embodiment, in which:

FIG. 2*a* depicts a top plan view of a block of the current invention.

DETAILED DESCRIPTION

Components and System Overview

Figures 1A, 1B:
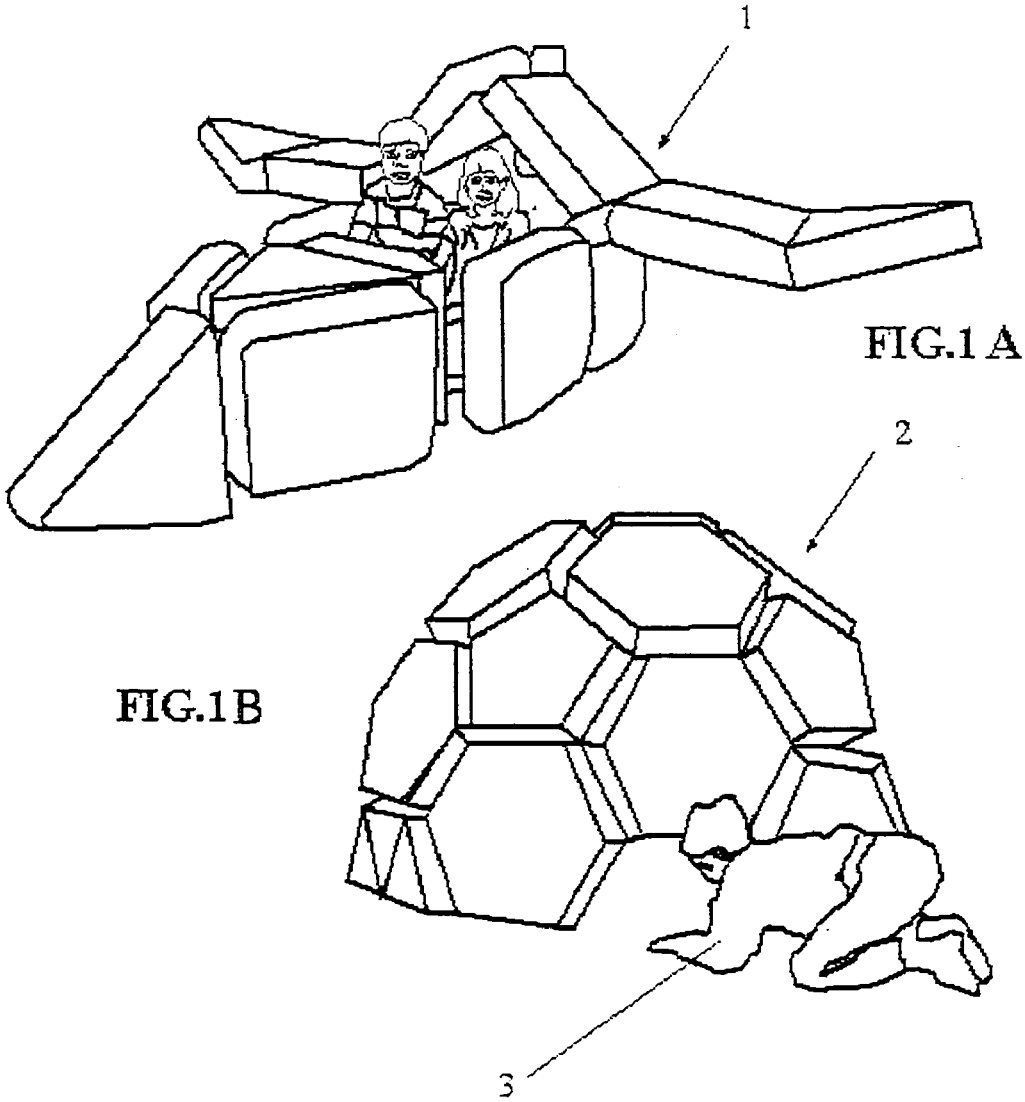
FIG. 1*a* depicts a toy aeroplane made from the blocks of the current invention.
FIG. 1*b* depicts a toy igloo made from the blocks of the current invention.

Referring now descriptively to the drawings, in which similar reference numbers denote similar elements throughout the several views, specifically in FIGS. 1A and 1B there is shown an example of the versatility of configurations which can be constructed easily by children and limited only by imagination. In FIGS. 1A and 1B, two potential configurations that map to the most common play structures favored by children are shown. The first structure is a simulated airplane 1 whereby children can engage in imaginary play of takeoff, flying, and landing. Likewise, a simulated igloo 2 provides hours of fun and can double as forts, club houses, meeting place, etc. which by any other means of material or construction method would be difficult. The sizes of the structures are readily apparent relative to an actual scaled drawing of an eight-year old boy 3.

Designs and Layouts

Referring now to FIGS. 2*a*–2*d*, what is shown is a sample baseline building block in perspective view. In this embodiment there are a total of 16 connectors per block. This number was derived based on an optimized design that meets the requirements of structural stability, ease and speed of connectivity, economic considerations, and aesthetics. Unlike other products in the market, this design does not require connectivity along the entire edges of the blocks, a prior-art feature which is neither user-friendly for children nor economical. This current design optimizes the balance between desired features and other factors such as the intended audience's ability to enjoy the process of constructing life-size structures with relative ease and in a short amount of time.

It has been found by experiment that when the connectors are positioned in an alternating design, connectivity with other blocks is optimized, in both strength and integrity of the connection, as will be demonstrated.

Figure 2C:
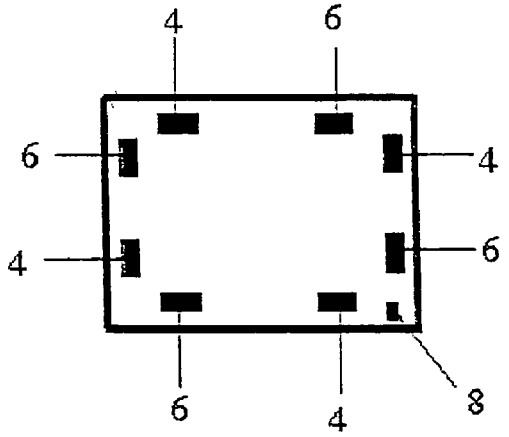
FIG. 2*c* depicts a side elevation view of a block of the current invention.
Figure 2B:
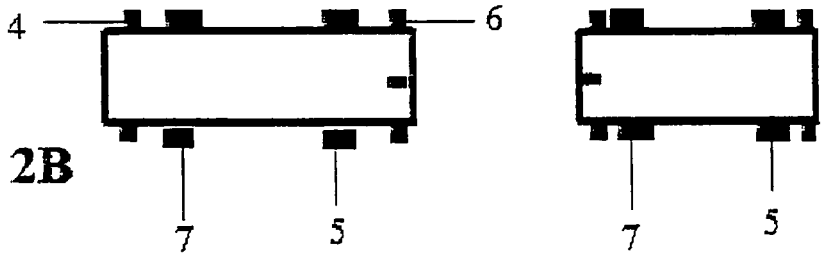
FIG. 2*b* depicts a front elevation view of a block of the current invention.
Figure 2D:
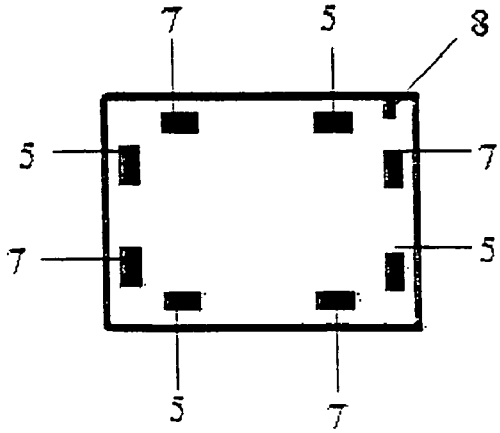
FIG. 2*d* depicts a bottom plan view of a block of the current invention.

Still referring to the top plan view of FIG. 2*a*, a hook and loop strap assembly 4, made of material such as that provided by Velcro® would always be located at position one in proximity to the air valve 8. The next connector 6 proceeding clockwise around the periphery of the upper surface depicted in said top view will necessarily be a vinyl flap 6. For optimized stability of built configurations, the bottom surface connectors will have matching positions relative to the top surface. Referring now to FIG. 2*d* it is seen that a matching hook and loop strap 4 on the bottom surface will be disposed directly below the top surface strap 4 as shown in FIG. 2*a*, and the matching vinyl flap 6 will likewise be disposed directly below the top vinyl flap 6. This layout ensures maximum stability by allowing the connectors to connect at either the top or the bottom edges. This design allows for connections of two or more building blocks on any edge and in any direction.

Referring again to FIG. 2*a*, it is seen that the straps and flaps are alternated as one proceeds clockwise around the top surface of the block. Starting at the bottom right corner in proximity to the air valve 8, a strap 4 is located, followed by a flap 6, then a strap 4, and so on. This pattern can be better viewed by referring to FIG. 4. The same alternation between straps and flaps appears on the lower surface, as shown in FIG. 2*d* and FIG. 4.

The air valve 8 is similar to those commonly used for inflation/deflation of children's inflatable toys. Note that upon completion of inflation, the air valve can be depressed into the blocks so as to form a non-protruding surface. The user may inflate a block by blowing into the valve. Alternative embodiments provide for mechanical or electrically powered pumps to assist in the inflation.

Figure 3A:
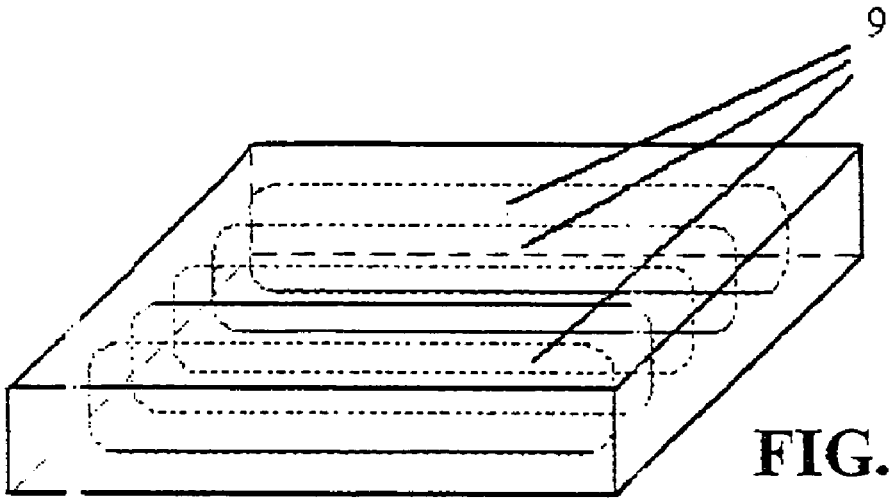
FIG. 3*a* depicts a perspective view of a block with internal I-beam supports.
Figure 3B:
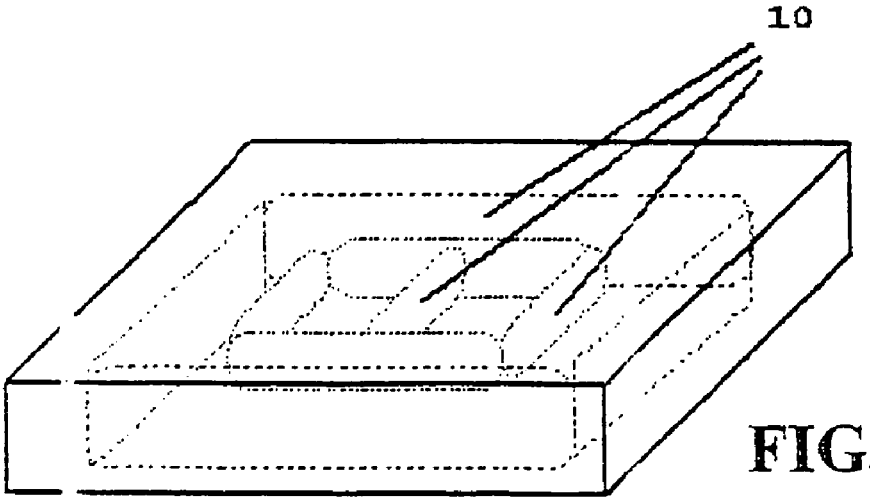
FIG. 3*b* depicts a perspective view of a block with internal coil beam supports.

Referring now to FIGS. 3A and 3B, which use a rectangular parallelepiped as an example, the baseline objects can retain desired shapes by using internal support layers in the configuration of I-beams 9 or coiled beams 10. Given the material properties of heat-sealable vinyl, this internal framework allows for the functional as well as aesthetic objects to be achieved. Such internal structure is also critical for keeping the surface bulges to designed specifications.

Figure 4:
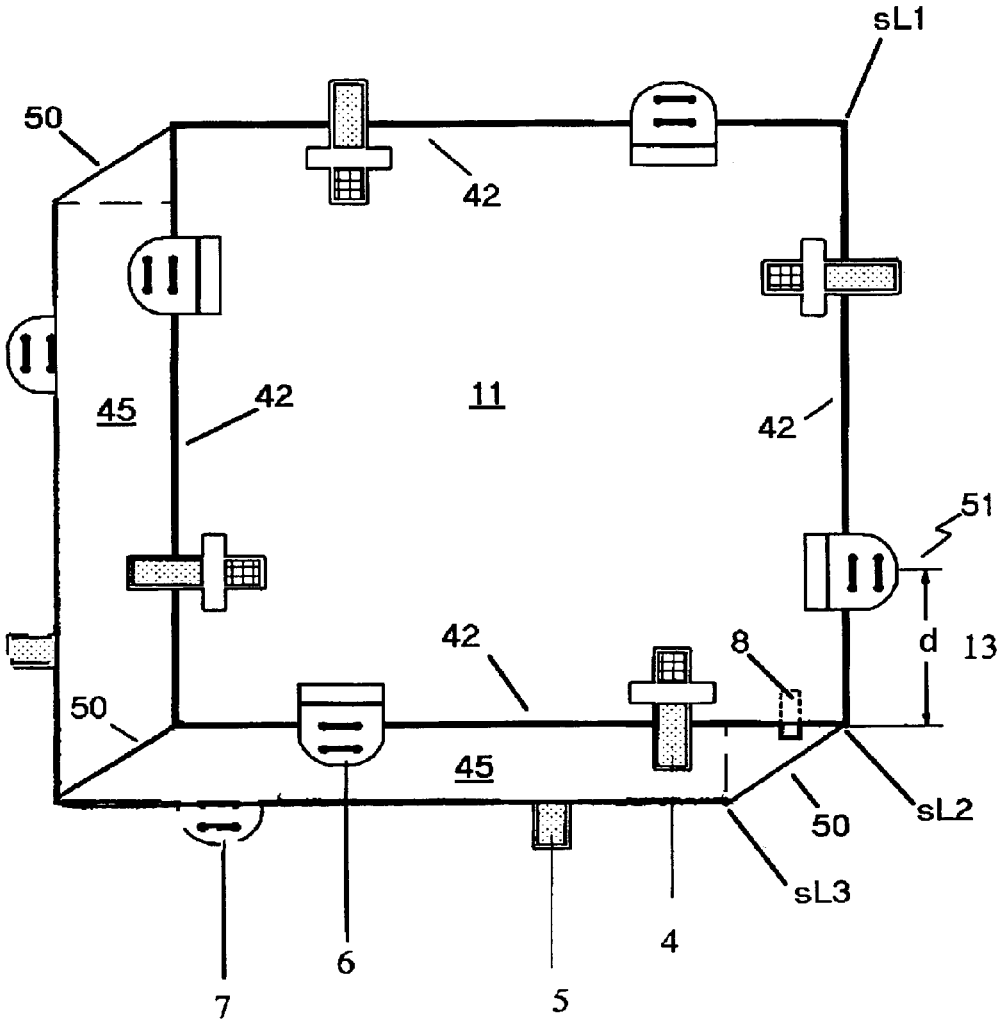
FIG. 4 depicts a perspective view of a block showing attached connectors.

FIG. 4 describes a key design element of the present invention. Not only are the connectors positioned in an alternative design pattern, but they are also mapped from the top surface 11 to bottom surface 12. It has been demonstrated with actual prototypes that this design allows for the connectivity of blocks that form three dimensional structures to become more stable. This stability is achieved by connecting along the bottom edges of blocks for angular structure such as an angled roof, yet also allowing the connection around the top edges when constructing flat roofs. In the latter construction, the roof would be connected along the edges but also would leverage the friction and shape of the block to prevent the structure from wobbling.

Still referring to FIG. 4, another crucial design element is the location of the connectors. In order to optimize balance and ease of construction, it has been determined that a minimum of two connectors per edge would be sufficient. However the key is to determine the exact location of the connectors relative to the block's dimension. Specifically, the distance d of each connector measured from the center line of the connectors to the nearest corner is determined as a function of the block's lateral length L. In the current design, given the desired number of minimum connectors (n=2), the distance 13 is calculated by dividing the total length into n zones, and finding the midpoint of each zone where the centerline of the connectors would align.

In all of the discussion of dimensions which follow, whether actual numbers or percentages or ratios of other dimensions, the tolerances which apply are plus or minus one quarter of an inch.

Thus, the distance d from one edge of a block to the first connector in the present invention, as shown in FIG. 4, is given by the equation $$DC=L/(2n)$$

where

L is the length sL1–sL2 of a surface seam 42 of the block;

n is the number of connectors on the same surface seam 42 of the block; and

DC is equal to d, which is the distance from the end sL2 of the surface seam 42 of the block to the mid-point 51 of the first, or nearest, connector.

The distance between adjacent connectors and either the top 11 or bottom 12 surface of a block is always 2*DC.

This same principle would apply if the number of connectors subsequently increase as in the case of a rectangle shape. As an example, since by design the rectangle's lateral length is a multiple of that of the square, the connectors could double to 4 units. The same design principle would apply and the connector would retain the same relative distance from the nearest corner and (in this case) the rectangle's centerline. This design applies to all polygons sharing the same lateral length, thus any and all polygons within this design will connect with any other block within this design without undue difficulty.

The Connector Assembly Details

Figure 5A:
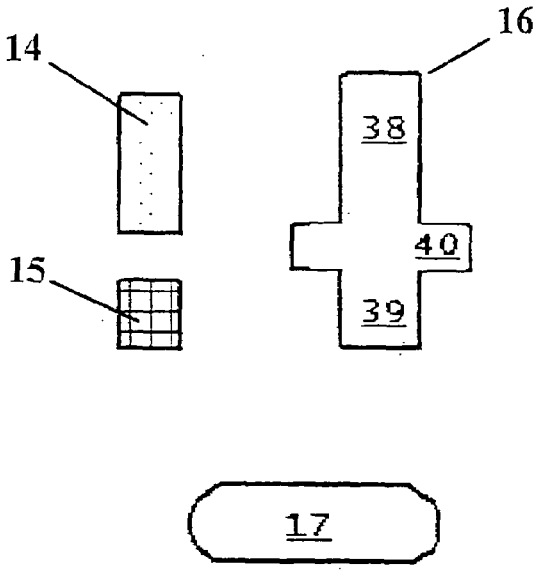
FIG. 5*a* depicts an exploded view of a strap connector.
Figure 5B:
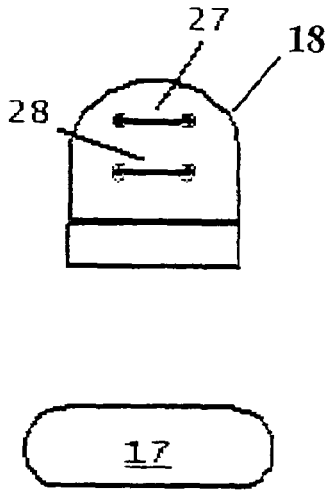
FIG. 5*b* depicts an exploded view of a flap connector.
Figure 5C:
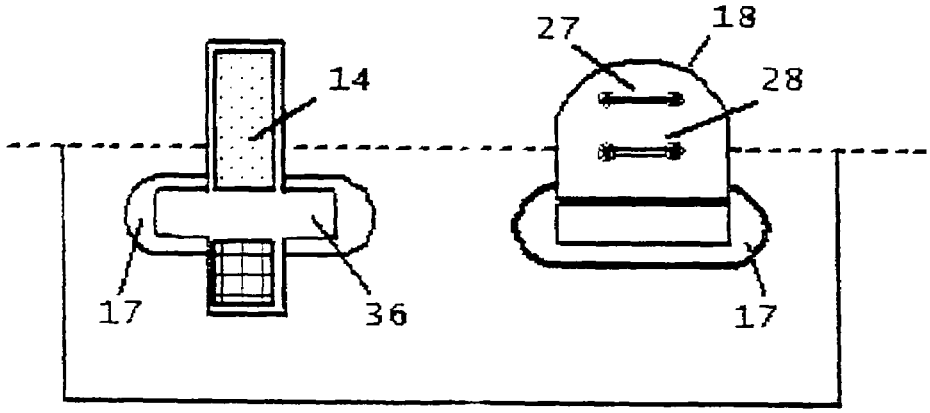
FIG. 5*c* depicts a strap connector and flap connector attached, side-by-side, to a block surface.

Turning now to the details of the connector designs, FIGS. 5A, 5B, and 5C show the individual components that, when assembled, make up the connector assemblies.

The hook and loop strap assembly has three components. The first is made of the softer component of the hook and loop combination, hereafter referred to as the female section 14. The second is made of the rougher part of the hook and loop combination, hereafter referred to as the male section 15.

The assembly is completed by cutting a piece of reinforced vinyl, having a thickness of approximately 0.30 mm, in the shape of a cross 16 to serve as the mounting for the hook and loop sections. Both the female and the male hook and loop sections are heat-sealed onto the vinyl cruciate housing 16. The female section 14 is affixed to the long section 38 of the vertical part of the cross, while the male section 15 is affixed to the shorter portion 39 of the vertical part of the cross, thus, leaving an exposed area of vinyl in the horizontal part 40 of the cross.

This horizontal part is where the actual heat sealing takes place. An additional component made of the same vinyl material but doubly reinforced is called the oval connector mount 17. When assembled onto the building block the female 14 and male 15 hook and loop components are heat sealed onto the cruciate vinyl housing 16, which is then heat sealed onto the oval connector mount 17. The entire assembly is then heat-sealed onto the building block's top or bottom surface as a final step.

This multi-layered approach ensures product durability and protects against potential misuses and over exertion of pulling above and beyond the recommended tolerance level. The resulting strap assembly may be seen in FIG. 5*c*.

The vinyl flap assembly 18 is a three-layered vinyl structure. The middle layer is heat-sealed along the open slits whereas the top and bottom layers are sealed along the edges. This design ensures the durability and protection against potential misuses. Sealing of the vinyl flap assembly is done in the same fashion as the hook and loop strap assembly. It is also sealed onto an oval connector mount 17, which is then sealed onto the block.

Figure 6:
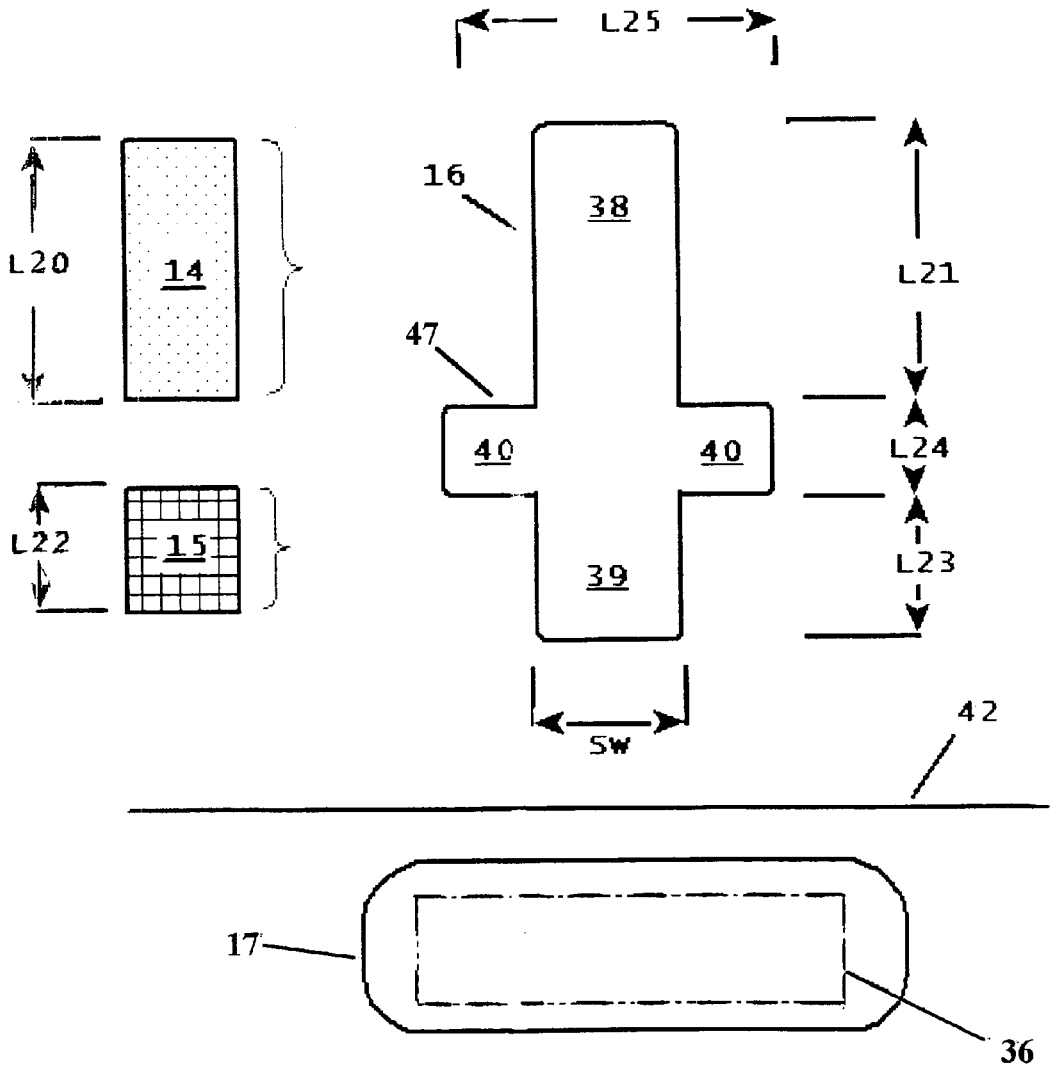
FIG. 6 depicts an exploded view of a strap connector.

FIG. 6 shows the design details that dictate the relative sizes of the hook and loop strap assembly. These dimension are determined as a function of the block's overall size and shape, and need to be adhered to closely to ensure maximum functionality of the product relative to the desired functionality and benefits. The female hook and loop section 14 having the length 20 as shown, will necessarily require a corresponding vinyl cruciate housing 16 having the length L21 as shown. The section of the cruciate housing on which the hook and loop section is attached must have a width and length of 125% (plus or minus 5%) of the corresponding hook and loop sections 14, 15, to allow for the extra vinyl material, which is soft and pliable, to act as a cushion along the rougher edges of the hook and loop sections. If these relative dimensions are not maintained, the connectors may cause the user to sustain skin abrasions.

In the same way, the male hook and loop section 15, having a length L22, is mounted on the lower vertical area of the vinyl housing 39 that is 125% the length of the corresponding hook and loop section.

The horizontal portion 40 of the cruciate housing is affixed to an oval connector mount. Ideally 100% of the surface of said horizontal portion, having the length L24 and width L25, will be heat sealed onto that portion of the Oval connector mount 17 shown in FIG. 6 in the shape of a rectangle 36, centered within the oval mount. The actual dimension of the oval connector mount is a function of balancing the desired connector durability and aesthetics, and is not critical in this invention.

Figure 7:
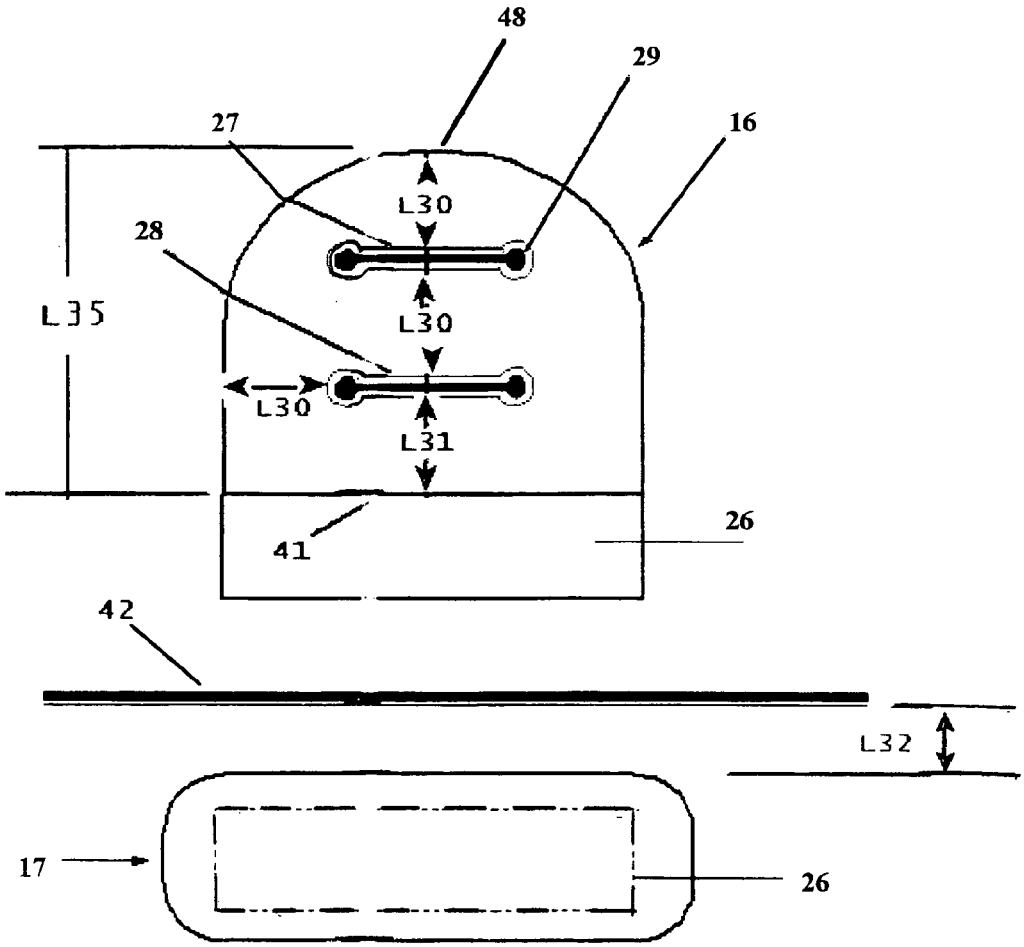
FIG. 7 depicts an exploded view of a flap connector.

FIG. 7 depicts the design dimensions of the vinyl flap. The vinyl flap has two slits, each one having the length at 125% of the hook and loop strap width, shown as SW in FIG. 6, to ensure ease of insertion and extraction of the strap into the flap during connectivity. A key design element of the vinyl flap is the number of slits. The first slit 27 will necessarily have a distance no less than L30 from any edge of the vinyl flap. The separation between the first and the second slit 28 is of the same distance L30.

The most critical dimension is the distance between the second slit 28 and the base 41 of the flap 18 where the heat sealing is done. The calculation depends upon the amount of bulge in side panels 44 of the blocks. Because of the nature of the material and its construction and internal support, it is almost impossible to construct a block which has perfectly right-angle corners. Rather, the sides bulge out, so that blocks set side by side and touching do not have their end seams 50 in contact. This situation may be further understood by referring now to FIG. 11 which is an elevation view of two blocks in contact, with the top surfaces 11 in view. The size of the bulges 49 are exaggerated relative to the size of the blocks for illustrative purposes.

Figure 11:
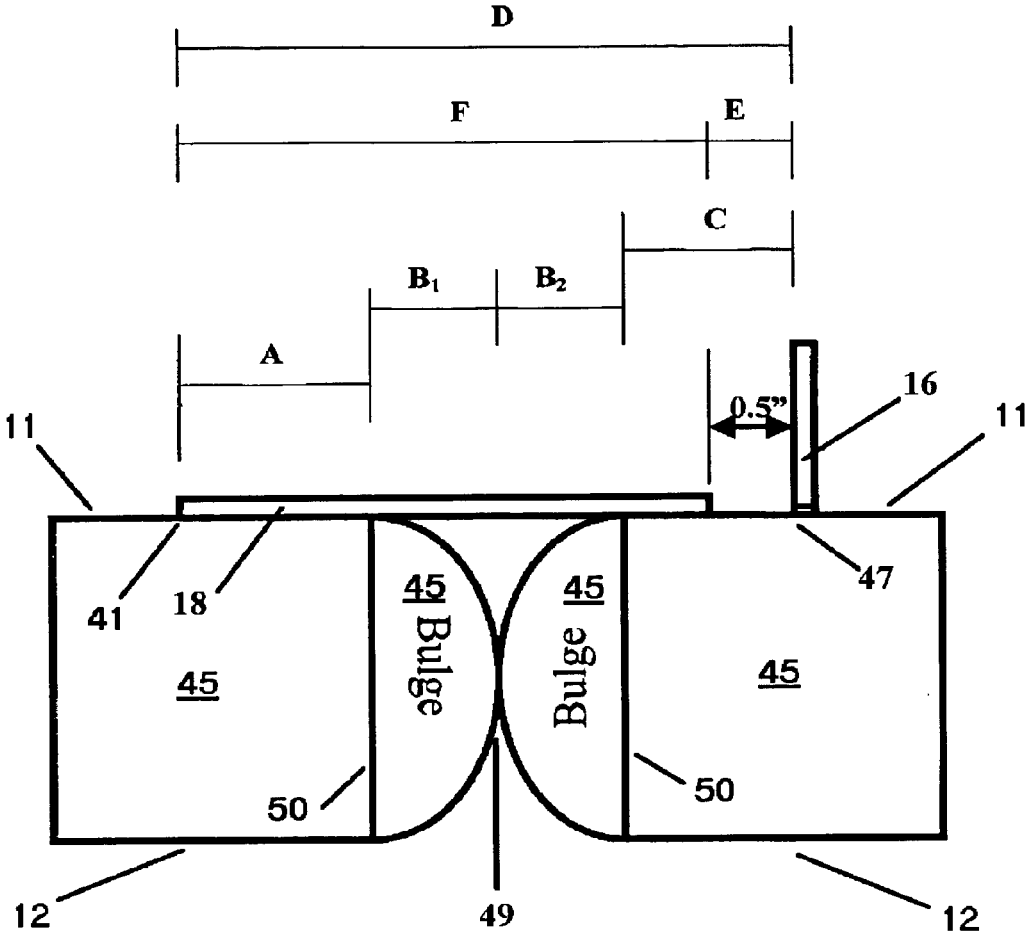
FIG. 11 depicts two blocks touching, showing the bulges in each.

Still referring to FIG. 11, the calculation of the distance between the second slit and the base of the flap is made as follows:

1. Place the two blocks side by side, with the side panels touching at the high point of the bulges 49, so that the connectors will be matching. That is, each strap will face a corresponding flap.

2. With the side panels touching, but not squeezed together with any force, the fully extended flap 18 should be ½ inch away from the baseline 47 of the corresponding strap 16.

The following equations will hold:

$$D=A+B1+B2+C$$

$$F=D-E$$

where:

A=distance between flap base 41 and seam line 42

B1=Bulge of the first block

B2=Bulge of the second block

C=Distance between the strap base 47 and seam line 42

D=Total distance between bases of the flap 41 and the strap 47

E=Distance between tip of the flap 48 and strap base 47

F=flap length L35

Once the measurements of the bulges B1 and B2 are made, D and F are calculated. F will be the length of the flap that will be optimal.

For sample blocks, in which the bases of the flaps and straps are one inch from the side seams, the equations reduce to the following:

$$D=1+B1+B2+1$$

$$F=D-0.5$$

With this method of calculation, one can ensure that there is sufficient friction when two adjacent pieces are connected to provide for structural integrity, while ensuring that the amount of air pressure is within the pulling strength of the intended younger users, so as not to cause unnecessary frustrations.

The ends of each slit are terminated by needle eyes 29, which make the slits easier to thread through with the hook and loop connectors.

Figure 8A:
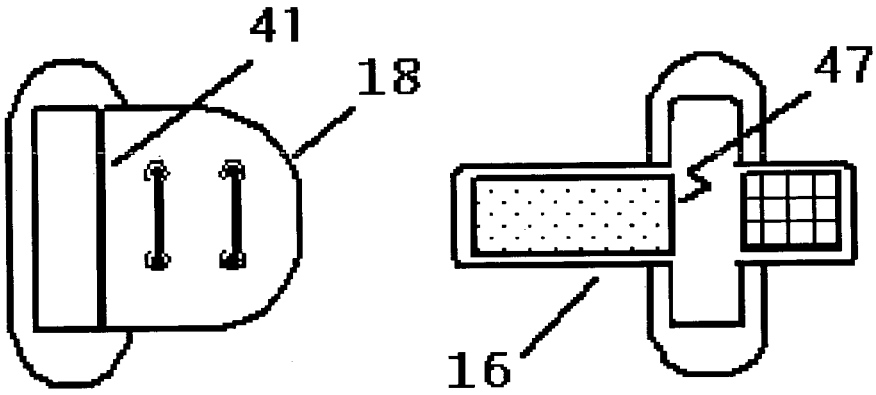
FIG. 8*a* depicts a flap connector in proximity to a strap connector.
Figure 8B:
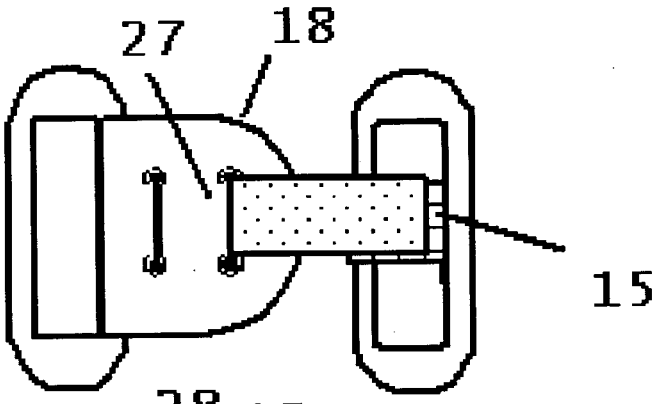
FIG. 8*b* depicts the strap connector affixed to the upper slit of the flap connector.
Figure 8C:
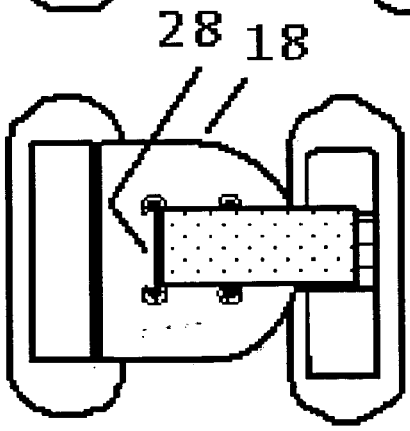
FIG. 8*c* depicts the strap connector affixed to the lower slit of the flap connector.
Figure 9A:
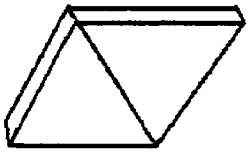
FIG. 9*a* depicts a rhombus made from blocks.
Figure 9B:
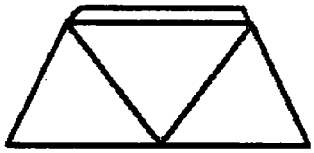
FIG. 9*v* depicts a trapezoid made from blocks.
FIG. 9*c* depicts a prism made from blocks.
FIG. 9*d* depicts a pyramid made from blocks.
FIG. 9*e* depicts a stack made from blocks.
FIG. 9*f* depicts an acute angle array made from blocks.
FIG. 9*g* depicts an orthogonal array made from blocks.
FIG. 9*h* depicts a coplanar pair made from blocks.
Figure 9C:
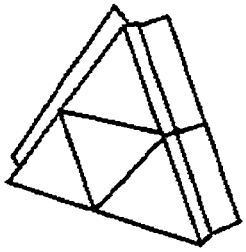
Figure 9D:
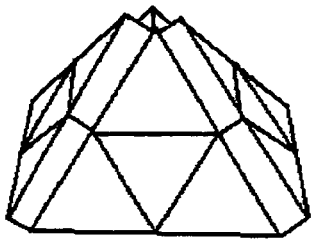
Figure 9E:
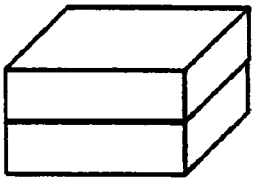
Figure 9F:
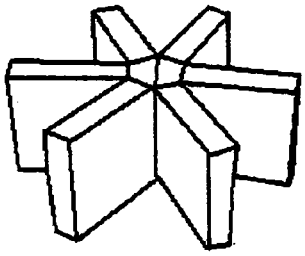
Figure 9G:
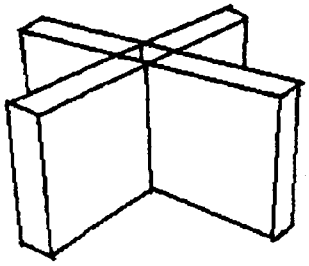
Figure 9H:
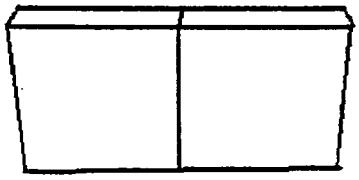

FIGS. 8*a*–8*c* illustrate the correct technique for connectivity. In the open position as shown in FIG. 8*a*, the connector assemblies will face each other along any edge of the blocks. Referring to FIG. 8*b* the connection can be made by looping the female side of the hook and loop strap through the first slit 27, and folded back to mate with the male hook and loop section 15, which also requires folding in the same direction. This connection is utilized to connect co-planar configurations where large or long walls or panels are connected on both the top and bottom surfaces. Based on actual prototype testing, the resulting structure will have significant structural integrity to be handled as a single piece.

Another connectivity technique is shown in FIG. 8*c*, and requires that the female hook and loop strap loop through the second slit 28 and fold back the same way as with the first technique of FIG. 8*b*. This connection is best utilized in any angular connection where the edges need to maintain as close contact as possible to enhance structural integrity. This type of connection can be used along simulated angled roofs, walls, or any surface that requires flexibility.

Configurations and their Operation

This present invention leverages the power of equilateral shapes to construct complex geometric shapes as has been demonstrated in the field of mathematics and architecture. Within this family, referred to herein as "polygons", a plurality of each base unit can be used to construct more complex structures in 2 dimensions or in 3 dimensions, and/or combined to form multiple structures. The key to this capability lies in the fact that each of the said baseline units is equilateral in design while all baseline building blocks share the same length per side. The resulting geometry is that the triangle will consistently produce 60 degree angles, the square at 90 degrees, the pentagon at 108 degrees, and the hexagon having 120 degrees angles. Such shapes will be referred to hereinafter as "regular polygons".

FIG. 9 illustrates how one can apply the same educational principle and create parallelograms outside of the aforementioned triangle and square. Shown in the figure are 4 complex configurations built with triangles. The rhombus and the trapezoid can also be used as baseline configurations to build even more challenging structures such as the Prism and the Pyramid.—Another one of the key design strengths of the present invention is the ability to enable various angles of connectivity with the building blocks. Unlike existing products made of inflatable vinyl material in the form of interlocking designs, the present invention's alternating loop and strap design not only secures two or more baseline building blocks, but also enables connecting edges to form angles ranging from zero to 360 degrees.

Also shown in FIG. 9, a coplanar construction is made possible by connecting one edge of each of the two baseline units. An acute angle of 60 degrees is achieved by connecting two edges of 6 baseline units thus forming six 3-D isosceles triangles. Orthogonal angles can be formed in not one, but up to 4 connecting angles of 90 degrees each. Yet another coplanar connection can be made, but this time by securing two edges of the two baseline units. Lastly, obtuse angles measuring 120 degrees each are made by aligning two edges of three baseline units. As can be demonstrated by these sample connections, the desired angle can be accomplished and only limited by the number of available baseline building blocks.

Figure 10:
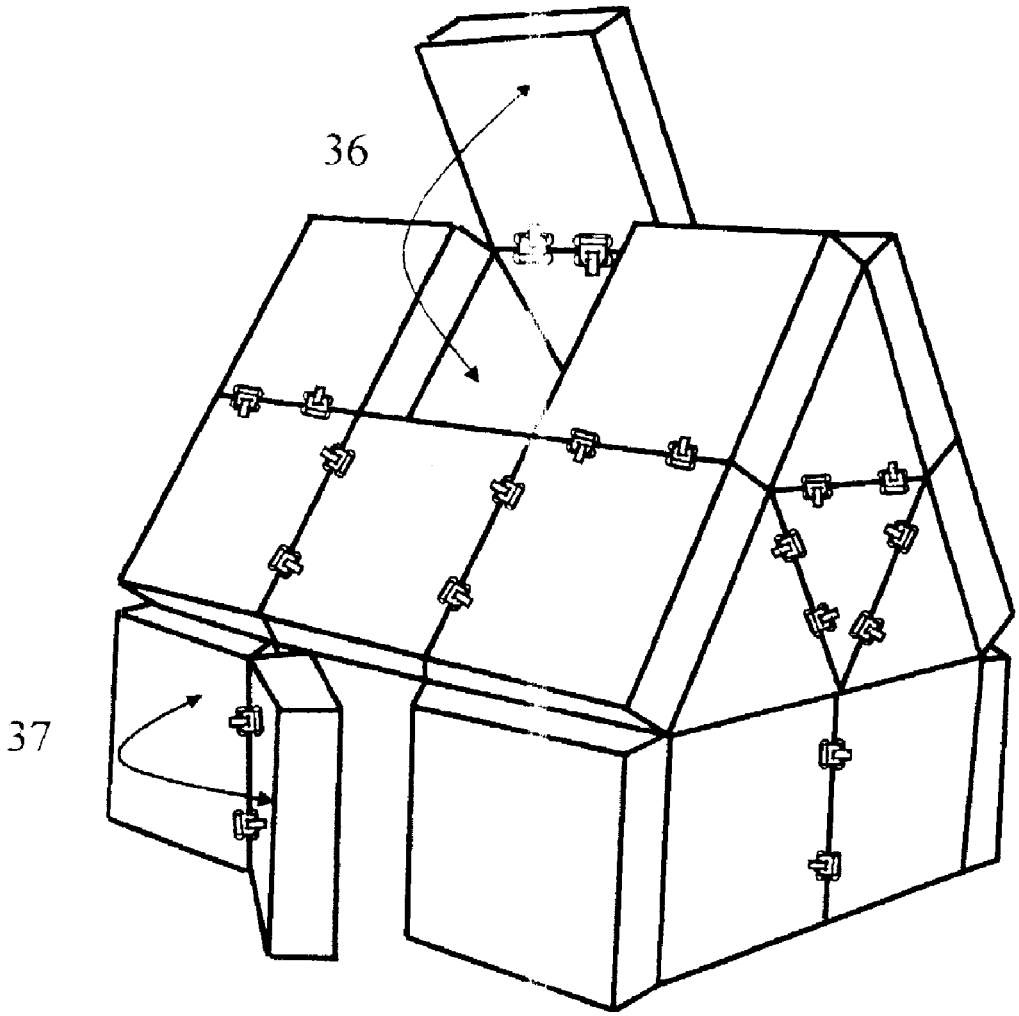
FIG. 10 depicts a toy house made from blocks.

Finally, FIG. 10 illustrates one of most powerful and enjoyable aspects of the play structures. It is now possible to create multiple openings such as doors, skylights, windows, secret entrances/exits by means of connecting along only a single edge of a particular unit. As shown, an upward and downward motion that a skylight 36 would exhibit is now possible. Also possible is a sideways motion as would commonly be exhibited by a swinging door 37.

When the play structure is to be disassembled, the block components can be easily deflated by simply releasing the air within. Storage of the deflated vinyl blocks can be easily accomplished by simply storing the deflated sheets in small containers. Furthermore, to transform one structure to another, the user simply identifies what additional, if any, shapes and quantities thereof are required. Thus the present invention offers unlimited scalability in design and additions not limited by a manufactured physical form.

To further enhance the entertainment value that this building block system offers, color coding, specific themes, and cloth slip covers may be utilized to display a full pattern of the desired designs. Other embodiments can take the form of a puzzle which younger users can utilize to assemble large murals.

Clearly, to enjoy the design, creation, and construction of life size structures enabled by the present invention, one requires no more than the inflation of the building blocks and the simple connections along the edges. The degree to which one can enjoy this product is immeasurable because of its variability in finished shapes and forms, and because of the challenge it presents to anyone with an interest in building a structure. Whether the finished configuration is a 3-piece tunnel, a 4-piece dog house, a 5-piece fort with a door that opens, or a 30-piece food stand with swing open latches, doors, windows, etc., this product affords participants from three years old to adults of any age to enjoy the process and social interactions and the pleasure from a sense of accomplishment.

As previously stated, the basic building blocks have cross sections which are regular polygons; that is, having a multiplicity of sides each of which has the same length as every other side. In mathematical terms, such a structure can be defined as a right cylinder having a polygonal cross section, or, for simplicity, a "regular polygonal cylinder", which is the term that will be used hereinafter. The side of each polygon has the same length as the side of every other polygon in the preferred embodiment. The side length is referred to hereinafter as the "base side length".

In an alternative embodiment additional building blocks are included which consist of polygonal cylinders whose base side is different from the base side of the smallest building blocks, whose length will be referred to herein as the "fundamental base side" length. All other building blocks will have a base side whose length is an exact multiple of the fundamental base side length. Thus, a building block having a rectangular cross section and a fundamental base side length of "m" may be included, together with another building block having a rectangular cross section and a base side length of "2 m". Thus, two of these smaller, or fundamental rectangular blocks would be required to mate with one side of a larger rectangular block as just described.

In a further alternative embodiment the system may include larger building blocks which are regular polygons.

It will be apparent that improvements and modifications may be made within the purview of the invention without departing from the scope of the invention defined in the appended claims.

The invention claimed is:

1. A system for the construction of life size play structures comprises a multiplicity of inflatable blocks, wherein each block further comprises:

(a) an identical top polygonal surface and bottom polygonal surface, each surface comprising a multiplicity of surface seams at the periphery of the surface and each surface seam comprising two ends;

(b) a multiplicity of side panels, each joined at the top surface seam and at the corresponding bottom surface seam, each side panel affixed to an adjacent side panel by means of a side panel seam;

(c) A multiplicity of strap connectors and a multiplicity of flap connectors, each having a centerline, whereby two or more connectors are affixed in proximity to each seam of the top surface, and whereby two or more connectors are affixed in proximity to each seam of the bottom surface, whereby said strap connectors and flap connectors are alternated about the seams on each surface, and whereby an end connector has a center line which is located at a distance of approximately DC from the nearest seam end, where DC is defined by $$DC=1/(2n)$$

where l is the length of the seam, and n is the number of connectors on the seam, and wherein each connector on each surface seam has a center line located at a distance of 2*DC from the nearest other connector on the same surface seam, so that each strap connector affixes to a slit in a corresponding flap connector on another block.

2. The system of claim 1, wherein each of said flap connectors on the upper surface is adjacent to a flap connector on the lower surface, and whereby each of said strap connectors on the upper surface is adjacent to a strap connector on the lower surface.

3. The system of claim 2, wherein each of said strap connectors comprises a cruciate mount comprising a horizontal area, an upper vertical area and a lower vertical area, wherein a portion of male hook-and-loop material is affixed to the upper vertical area, and a portion of female hook-and-loop material is affixed to the lower vertical area, and whereby the horizontal area is affixed to an oval mount.

4. The system of claim 3, wherein each flap connector has formed within it two or more slits, each approximately 125% of the width of the vertical area of a corresponding strap connector, and wherein each flap connector further comprises a mounting area in proximity to a bottom edge of the flap connector, and which is affixed to a corresponding oval mount.

5. The system of claim 4, wherein each slit of each flap connector has needle eyes terminating each end.

6. The system of claim 5, wherein for each flap connector the slits are disposed parallel to each other, and wherein the distance between each slit and an adjacent slit is equal to the distance between an uppermost slit and an upper edge of the flap connector, and is further equal to the distance between each needle eye and the closest point on an edge of the flap connector.

7. The system of claim 6, wherein for each flap the distance of the first slit from any edge of the vinyl flap will be approximately equal to the separation between the first and the second slits of the flap.

8. The system of claim 7, wherein the distance between the second slit and the base of the flap are such that:

(a) when placing a first block and a second block side by side, with the side panels touching, so that each strap will face a corresponding flap; and (b) With the side panels of each block touching, but not squeezed together with any force, and a fully extended, each flap is approximately ½ inch away from the baseline of the corresponding strap, then the following equations will approximately hold for a particular strap and flap:

$$(c)\ D=A+B1+B2+C$$

$$(d)\ F=D-E$$

where:

(e) A is the distance between the flap base and a corresponding seam;

(f) B1 is the bulge of the first block;

(g) B2 is the bulge of the second block;

(h) C is the distance between the strap base and the corresponding seam line;

(i) D is the total distance between the base of the flap and the base of the strap;

(j) E is the distance between a tip of the flap and the strap base; and (k) F is the flap length.

9. The system of claim 8, wherein the affixing of each connector to the corresponding oval mount is done by heat sealing, and wherein the affixing of each oval connector mount to the corresponding block is done by heat sealing.

10. The system of claim 9, wherein the blocks, flaps, and cruciate mounts are fabricated from polyvinylchloride.

* * * * *